United States Patent [19]

Nordstrom

[11] 4,249,551

[45] Feb. 10, 1981

[54] FINGERNAIL KIT

[76] Inventor: Stuart S. Nordstrom, 1720 Hunsaker St., Oceanside, Calif. 92054

[21] Appl. No.: 75,826

[22] Filed: Sep. 14, 1979

[51] Int. Cl.[3] ..... A45D 29/00

[52] U.S. Cl. ..... 132/73

[58] Field of Search ..... 132/73, 88.5, 88.7; 222/576; 220/24.5

[56] References Cited

U.S. PATENT DOCUMENTS

| | | | |
|---|---|---|---|
| Re. 25,906 | 11/1965 | Livingstone | 220/24.5 |
| 3,542,261 | 11/1970 | Greenberg | 222/576 |
| 3,662,769 | 5/1972 | Vasas | 132/88.7 |
| 3,885,578 | 5/1975 | Hicks | 132/88.5 |
| 3,921,650 | 11/1975 | Montgomery | 132/88.7 |

*Primary Examiner*—G. E. NcNeill

*Attorney, Agent, or Firm*—Brown & Martin

[57] ABSTRACT

A fingernail construction kit includes a pair of separate containers for containing chemical components for the fabrication of fingernails with one container for containing a liquid reagent including a detachable cover having an aperture therein for receiving a brush. The cover includes an annular ridge formed around the aperture for diverting the reagent back into the dish. The containers are constructed of high density polyethylene.

6 Claims, 5 Drawing Figures

FINGERNAIL KIT

BACKGROUND OF THE INVENTION

The present invention relates to the construction of artificial fingernails and pertains particularly to improvements in a kit for the construction of fingernails.

Long fingernails are quite fashionable in many circles today. The wearing of long fingernails has been a problem in the past. When a fingernail becomes broken it must be regrown or replaced by an artificial nail.

Certain techniques have been developed for the construction of fingernails from chemical compounds which when combined react to form a hardened structure having the appearance and general structural characteristics of a fingernail. Such techniques are now frequently used to form the structural features of an artificial fingernail which is then filed or ground to form the desired length and shape.

One technique involves the combining of a liquid monomer reagent with a powdered polymer reagent. The combination materials quickly react to form a hardened shell. Because of the speed with which the reaction occurs, it is desirable that the materials be mixed only at the time of application or immediately prior thereto. For this reason, the liquid and powder are typically kept in separate containers with the mixing achieved by dipping a brush in the liquid and then into the powder and applying the resulting mixture directly to the fingernail or fingernail form. This technique, as currently practiced, has a number of drawbacks.

One objectionable result of this practice is that the powder becomes mixed with the liquid reagent and quickly polymerizes. The dipping of the brush into the powdered reagent results in amounts of the powder remaining on the brush and becoming mixed with the liquid in the liquid container. As soon as this occurs, reaction begins to take place within the liquid in the container resulting in a considerable amount of the materials becoming non-usable.

Another objection is that the reacted material sticks to the containers and are difficult to clean.

Another drawback to this technique is that at least portions of the liquid is quite volatile. The liquid contains aromatic components which become quite noxious. The fumes from the liquid reagent can become quite unpleasant and often result in the causing of headaches to people who are closely associated or in close proximity therewith.

Accordingly, it is desirable that some means be available for eliminating or reducing the problems of the noxious fumes and premature mixing of the compounds.

SUMMARY AND OBJECTS OF THE INVENTION

It is the primary object of the present invention to overcome the above problems of the prior art.

Another object of the present invention is to provide a fingernail construction kit having means for considerably reducing the contamination of the liquid monomer by the powdered reagent.

A further object of the present invention is to provide means for reducing the influence of the volatile nauseous aromatic gasses escaping from the liquid reagent.

In accordance with the primary aspect of the present invention a fingernail construction kit includes a container for the liquid reagent which includes a detachable cover adapted to reduce the amount of solid which becomes deposited in the container and to reduce the escaping of aromatic compounds from the liquid container.

BRIEF DESCRIPTION OF THE DRAWINGS

The above and other objects and advantages of the invention will become apparent from the following description when read in conjunction with the drawings, wherein.

DETAILED DESCRIPTION OF A PREFERRED EMBODIMENT

Figure 1:
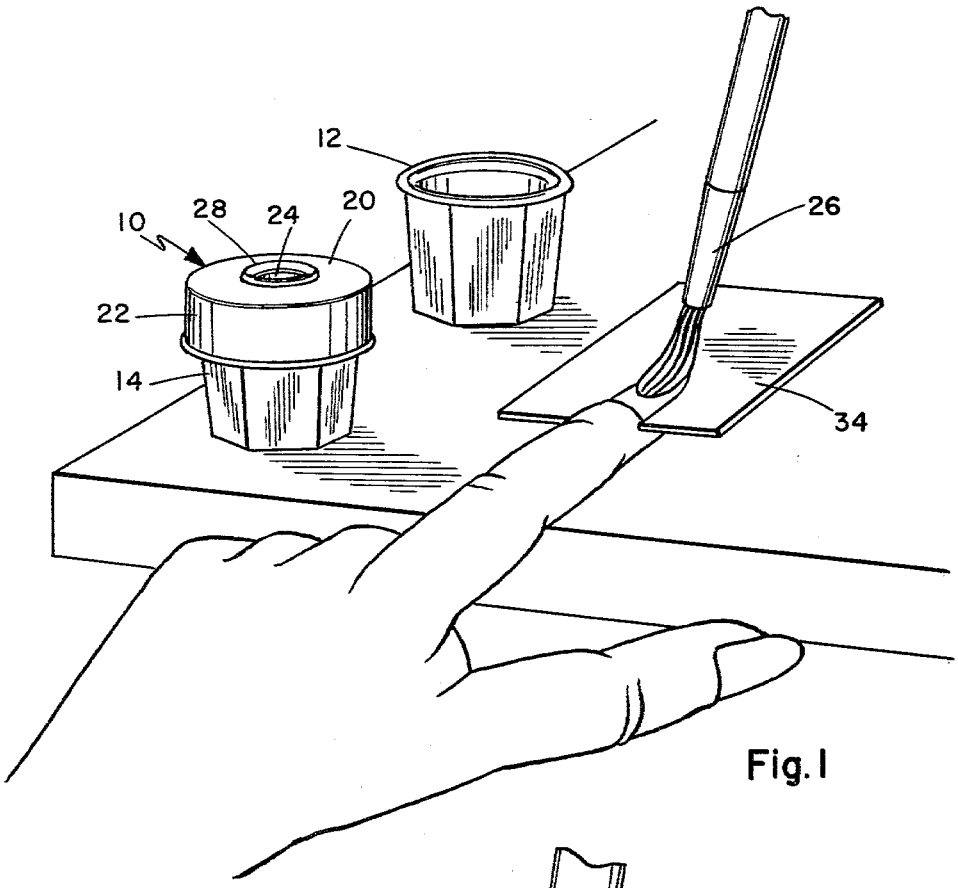
FIG. 1 is a perspective view showing a kit in accordance with the preferred embodiment of the invention.
Figure 2:
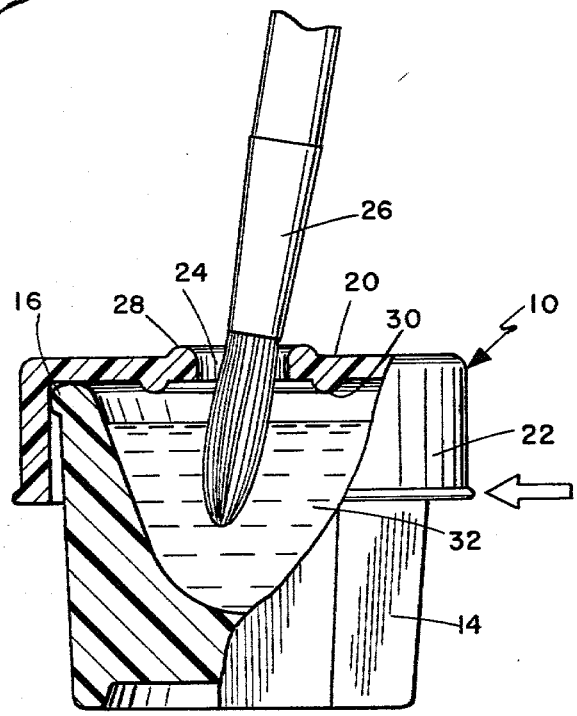
FIG. 2 is an enlarged side elevation view, partially cut away, of the liquid container.

Turning now to the drawings, there is illustrated in FIG. 1 a kit for the construction of fingernails which comprises generally a first container or dappen dish designated generally by the numeral 10 for containing a liquid and a second container or dappen dish designated generally by the numeral 12 for containing a powder reagent. The containers are preferably constructed of a highly polished high density plastic, such as high density polyethylene. Preferably the containers are substantially identical having a capacity of approximately 1 to 1½ millimeters or cubic centimeters of liquid. The dishes are preferably shaped to have a weighted bottom as shown in FIG. 2 to enhance the stability thereof. Weighted inserts such as lead or the like can be molded into the bottom of the dish if desired.

It has been found that the dishes themselves can be constructed substantially like dappen dishes utilized by dentists. Such dappen dishes from dentists practice have in fact been adopted for use in the fingernail construction practice. However, major modifications are needed in order to adapt and fit the top or cover to the dish.

These dishes or containers can be constructed of either a high density plastic such as high density polyethylene or a glass as is the dappen dishes for dentists' use. The high density, highly polished polyethylene plastic provides a low cost, lighter weight construction and permits much easier cleaning of the dish. The glass containers usually require soaking overnight in order to clean.

The plastic material is preferred since it is easier to maintain tolerance and to form a sealing lip for fitting with covers as compared to using glass. Glass undergoes greater dimensional changes during cooling that are impossible to control.

The materials become mixed in the liquid dish and solidify resulting in the necessity of cleaning the materials from the dish and cover. The cover is easily cleaned simply by flexing and breaking the material free. The material can also be broken free by means of a stick or the like. The dish and cover can also be cleaned by immersion in a cleaner such as Acetone for a few minutes.

Turning now more particularly to FIG. 2, there is illustrated in detail a preferred construction of the dappen dish together with the construction of the cover for the dish. A dish or container 14 is formed to have a rather thick lower wall and body with the walls thinning toward the top rim or edge. The upper edge or rim is preferably formed with a slight lip 16 to engage with the inside wall of the lid for sealing.

A lid 20 is adapted to fit the dish and is preferably constructed of a pliable, durable plastic. The lid includes an outer annular skirt 22 extending downward and over and frictionally engaging the lip of the dish for sealing and retaining the lid in place on the dish. The skirt 22 of the lid is long in relation to the height of the dish 14 (i.e., from $\frac{7}{8}$ to $\frac{1}{2}$ the height) in order to reduce tolerance requirements and assure a seal fit.

The top includes an aperture 24 of a size adapted to just permit the insertion of a brush 26 through the aperture into the dish. Surrounding the aperture is a lip or the like 28 which is adapted to assist in cleaning or wiping powder from the brush as the brush is being inserted through the aperture into the dish. This arrangement and construction has been found to be very effective to reduce the amount of powder accumulated on the brush from entering into the liquid in the dish 14.

An additional feature in the form of a further annular ridge 30 inside the lid or top 20 serves to force liquid to return directly into the dish rather than flow along the underside of the top to the other walls. When the brush is dipped into the liquid in the dish, it is then wiped on the rim or wall surrounding the opening. The liquid around the opening then flows along the underside of the cover to ridge 30 and drops directly down into the dish.

In operation, a pair of the dishes are set up with one dish containing a powdered reagent and the covered dish containing a liquid reagent. Mixture of the two reagents applied to the fingernail or a form solidify to form fingernails. The dish 14 containing the liquid 32 is provided with a cover 20 which serves the dual function of reducing the fumes escaping from the dish 14 and permitting the wiping of the brush or bristles of the brush 26 upon both removing the brush from the container with a liquid thereon and upon inserting the brush through the aperture into the container.

In use, the brush 26 is dipped into the liquid in the dish 14 and upon withdrawing is wiped on the inner walls of the aperture thereof and then dipped into the powder in the dish 12. The brush is then applied to the fingernail utilizing the material or chemical reagents mixed thereon for forming a fingernail like structure, that adheres to the fingernail and extends outward beyond the end thereof onto a shield or form 34. Continued application of the mixture to the formation of material on the fingernail results in the formation of a structure that extends outward or adheres to the fingernail and extends outward beyond the end of the finger onto the shield 34. Once the structure is formed and permitted to set or harden, it can be filed or otherwise ground and shaped into the desired fingernail shape and appearance.

With this construction, noxious fumes from the liquid are considerably reduced as well as any possible hazard or the like from such fumes. In addition, the mixing of powder from the powder dish into the liquid dish is considerably reduced. The brush 26 can take any suitable shape such as the form of an artists brush or the like.

The dish or container 14 is tapered outward toward the top with sides having flats for easier gripping and handling. For this reason a circular lip must be formed on the upper edge. The lip may take any number of shapes, such as are shown in FIG. 3 through 5.

Figure 3:
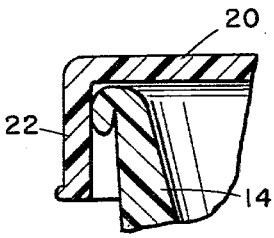
FIG. 3 is a detailed view in section of an alternate sealing lip.

The lip of FIG. 3 is similar to, but thinner than, that shown in the FIG. 3 embodiment. This form is believed to provide better sealing with less cutical tolerances.

Figure 4:
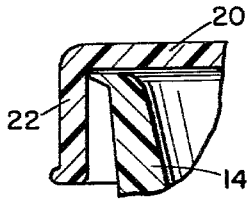
FIG. 4 is a view like FIG. 3 of another sealing lip.
Figure 5:
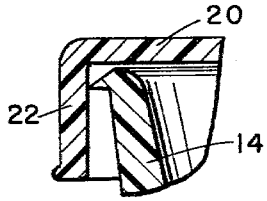
FIG. 5 is a view like FIG. 3 of still another sealing lip.

The FIG. 4 and FIG. 5 embodiments have sharp edges to provide further possible sealing advantages.

Other forms of lip construction such as O-rings and the like can be used. The lip or cap 20 is constructed to have a long skirt that can flex and adapt to the lip for sealing purposes. The long skirt has another advantage in that it provides means for easy opening of the top. A force applied at the lower edge of the skirt (arrow A in FIG. 2) snaps the top loose for any removal. The opposite side of the lid pops up.

While I have illustrated and described my invention by means of specific embodiments, it is to be understood that numerous changes and modifications may be made therein without departing from the spirit and scope of the invention as defined in the appended claims.

Having described my invention, I now claim:

1. In a kit for the construction of artificial fingernails comprising:

a first container defined by a thick high density bottom and upwardly extending walls forming a generally upwardly opening cavity having an upper opening equal to the maximum cross-sectional dimension of the cavity for containing a liquid reagent;

a cover detachably fitted on said first container over the opening for substantially covering said opening; and said cover being constructed to define an aperture of reduced size in said cover for receiving a brush in close fitting association therewith.

2. The fingernail kit of claim 1, wherein:

said cover constructed of a pliable plastic material including an annular wiping ridge surrounding and closely adjacent said aperture on the outside thereof, and a skirt that extends downward over the upwardly extending walls and has a length of approximately $\frac{1}{3}$ the height of the container.

3. The kit of claim 2 wherein said cover includes an annular ridge inside the cover spaced from and surrounding the edge of said aperture.

4. The kit of claim 2 wherein said dish is made of a highly polished high density polyethylene.

5. The kit of claim 4 including a second container substantially identical to said first container and containing a powdered polymer for reacting with said liquid to form a hardened structure.

6. The kit of claim 5 including a shield for surrounding a fingernail, and a brush having a size and shape for insertion into said aperture and for applying mixtures of said liquid and said powdered polymer to a fingernail surrounded by said shield.

* * * * *